US009787024B2

(12) United States Patent
Obata

(10) Patent No.: US 9,787,024 B2
(45) Date of Patent: Oct. 10, 2017

(54) LEVER-TYPE CONNECTOR

(71) Applicant: Sumitomo Wiring Systems, Ltd., Yokkaichi, Mie (JP)

(72) Inventor: Masayuki Obata, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 43 days.

(21) Appl. No.: 15/137,026

(22) Filed: Apr. 25, 2016

(65) Prior Publication Data

US 2016/0336686 A1 Nov. 17, 2016

(30) Foreign Application Priority Data

May 11, 2015 (JP) ..... 2015-096372

(51) Int. Cl.
*H01R 13/62* (2006.01)
*H01R 13/629* (2006.01)

(52) U.S. Cl.
CPC . *H01R 13/62938* (2013.01); *H01R 13/62955* (2013.01)

(58) Field of Classification Search
CPC ..... H01R 13/62938; H01R 13/6272; H01R 13/62955; H01R 13/62977; H01R 13/629; H01R 13/639
USPC ..... 439/157, 310, 345
See application file for complete search history.

(56) References Cited

U.S. PATENT DOCUMENTS 7,063,547 B2 * 6/2006 Toyoda ..... H01R 13/62938 439/157
9,461,395 B2 * 10/2016 Kataoka ..... H01R 13/62938
2003/0017026 A1 * 1/2003 Tachi ..... H01R 13/62938 411/157
2003/0162427 A1 * 8/2003 Shinozaki ..... H01R 13/62933 439/157
2007/0287310 A1 * 12/2007 Dekoski ..... H01R 13/62938 439/157

(Continued)

FOREIGN PATENT DOCUMENTS

JP 2013-20904 1/2013

OTHER PUBLICATIONS

Translation. JP-2013-020904. Naotaka, Tanigawa. Lever Type Connector. Jan. 31, 2013.*

*Primary Examiner* — Amy Cohen Johnson
*Assistant Examiner* — Milagros Jeancharles
(74) *Attorney, Agent, or Firm* — Gerald E. Hespos; Michael J. Porco; Matthew T. Hespos

(57) ABSTRACT

A lever (40) is formed with resilient arms (48) cantilevered in a direction substantially perpendicular to rotary shafts (15) of the lever (40) and intersecting with a circumferential direction about the rotary shafts (15), and locking projections (49) projecting from extending end parts of the resilient arm pieces (48) and configured to hold the lever (40) at an initial position by entering locking holes (20) and being locked. The locking hole (20) is formed with a locking edge part (21) located on a surface of a housing (10) facing the lever (40) and configured to lock the locking projection (49) and a recess (23) formed by recessing an inner surface part on a deeper side than the locking edge part (21), and the locking projection (49) is formed with a hooking portion (53) configured to enter the recess (23) while being locked to the locking edge part (21).

12 Claims, 8 Drawing Sheets

(56) References Cited

U.S. PATENT DOCUMENTS

| | | | | |
|---|---|---|---|---|
| 2009/0111301 | A1* | 4/2009 | Hiramatsu | H01R 13/64<br>439/133 |
| 2009/0181566 | A1* | 7/2009 | Shibata | H01R 13/62938<br>439/157 |
| 2014/0349504 | A1* | 11/2014 | Kuroda | H01R 13/62955<br>439/310 |

* cited by examiner

LEVER-TYPE CONNECTOR

BACKGROUND

1. Field of the Invention

The invention relates to a lever-type connector.

2. Description of the Related Art

Japanese Unexamined Patent Publication No. 2013-020904 discloses a lever-type connector in which a lever is mounted rotatably on a male housing and is formed with a cam groove. A follower pin is formed on a female housing and can engage the cam groove of the lever. The two housings are connected by rotating the lever from an initial position to a connection position while the follower pin is engaged with the cam groove. A resilient locking piece is formed on the lever and has a lock that engages a locking hole on the male housing for holding the lever at the initial position. The follower pin is inserted into the cam groove when the two housings are fit lightly, and a lock releasing portion of the female housing interferes with the lock to deflect the resilient locking piece. The lock disengages from the locking hole as the resilient locking piece is deflected, thereby permitting the lever to rotate from the initial position toward the connection position.

The resilient locking piece of the above-described lever-type connector twists when a rotational force toward the connection position is applied strongly to the lever held at the initial position. Thus, the locking portion may slip out of the locking hole due to a resilient restoring force of the resilient locking piece.

Thus, the invention aims to hold a lever reliably at an initial position.

SUMMARY

The invention is directed to a lever-type connector with a housing having a terminal fitting mounted therein. A lever is mounted rotatably on the housing and is configured to connect the housing and a mating connector by being rotated from an initial position to a connection position. A locking hole is formed on the housing. A resilient arm is formed at the lever and is cantilevered in a direction substantially perpendicular to a rotary shaft of the lever and intersecting a circumferential direction about the rotary shaft. A locking projection projects from an extending end of the resilient arm and is configured to hold the lever at the initial position by entering the locking hole and being locked. The locking hole has a locking edge located on a surface of the housing facing the lever and is configured to lock the locking projection and a recess is formed by recessing an inner surface part on a deeper side than the locking edge. The locking projection is formed with a hook configured to enter the recess while being locked to the locking edge.

The hook engages enters the recess when the locking projection is locked to the locking edge. Thus, the locking projection will not detach from the locking hole, thereby stabilizing a locked state of the locking projection and the locking edge part and holding the lever reliably at the initial position.

The hook may have a locking surface facing the recess, and the resilient arm may have a continuous surface connected to the locking surface. A boundary of the locking surface to the continuous surface may be recessed at an obtuse angle, and the locking edge may be wedge-shaped and locked to the boundary. Accordingly, the locked state of the locking projection and the locking edge is stabilized since the locking edge is locked to the boundary of the locking surface to the continuous surface to be fit into the boundary.

The resilient arm may be displaced in a direction to detach the locking projection from the locking hole while being twisted when the lever is rotated in a direction toward the connection position with the locking surface locked to the locking edge. Additionally, the lever may be formed with a pressing portion located to sandwich the locking projection between the locking edge and the pressing portion. The locking projection may have an auxiliary hook configured to be hooked to the pressing portion from the side of the locking hole with the locking projection sandwiched between the locking edge and the pressing portion. According to this configuration, the auxiliary hook is hooked to the pressing portion from the side of the locking hole when the locking projection is sandwiched between the locking edge and the pressing portion with the resilient arm twisted. Thus, the locking projection cannot detach from the locking hole.

The lever may have a flat plate-shaped arm and a substantially U-shaped slit may penetrate in a plate thickness direction of the arm. An area surrounded by the slit may define the resilient arm. An inner surface of the slit and an outer surface of the resilient arm may be parallel to the rotary shaft. A removal direction of a mold for molding the slit and the resilient arm is parallel to the rotary shaft. Thus, a mold structure can be simplified.

DETAILED DESCRIPTION

Figure 1:
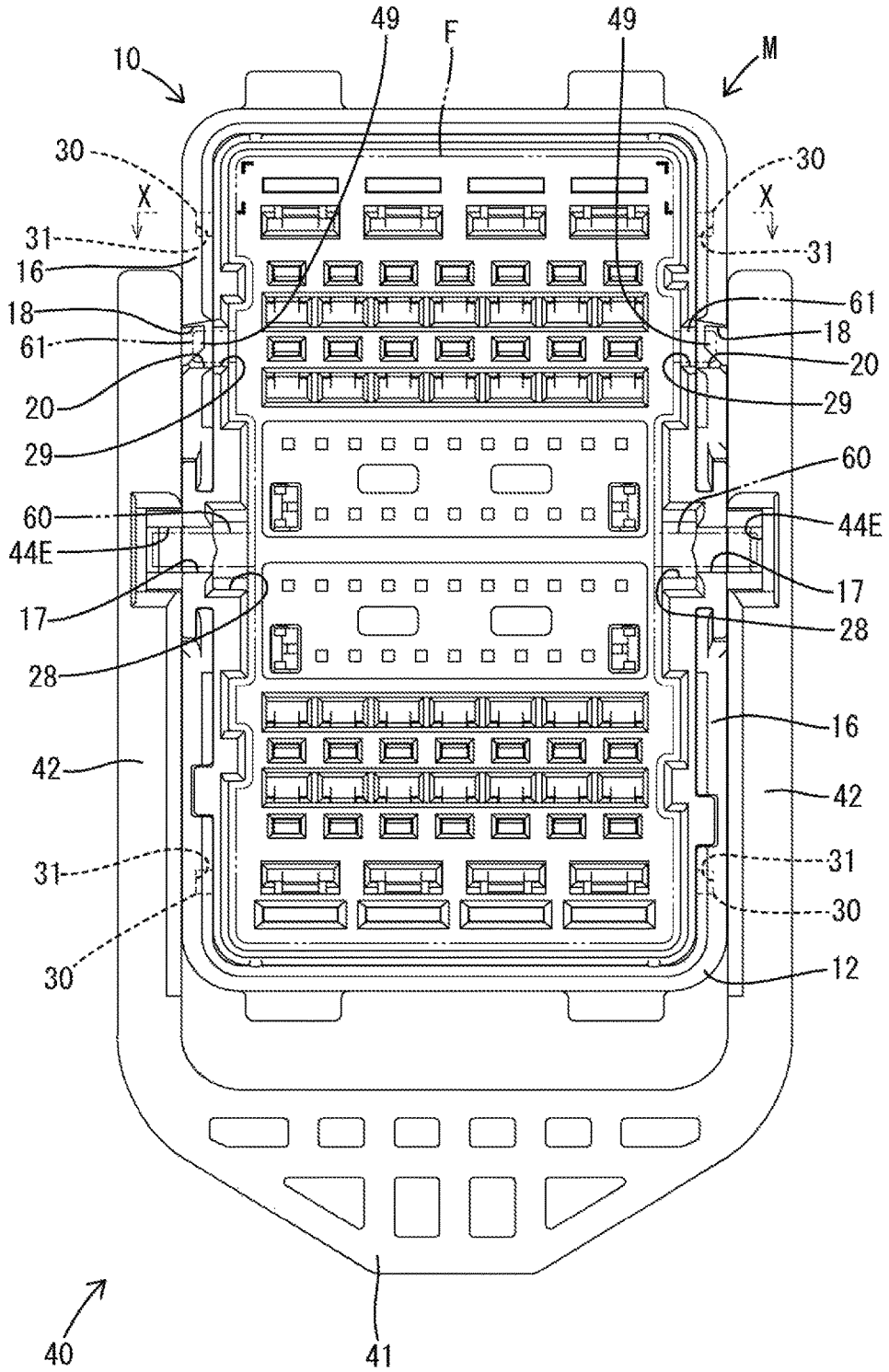
FIG. 1 is a front view of a lever-type connector of one embodiment.
Figure 7:
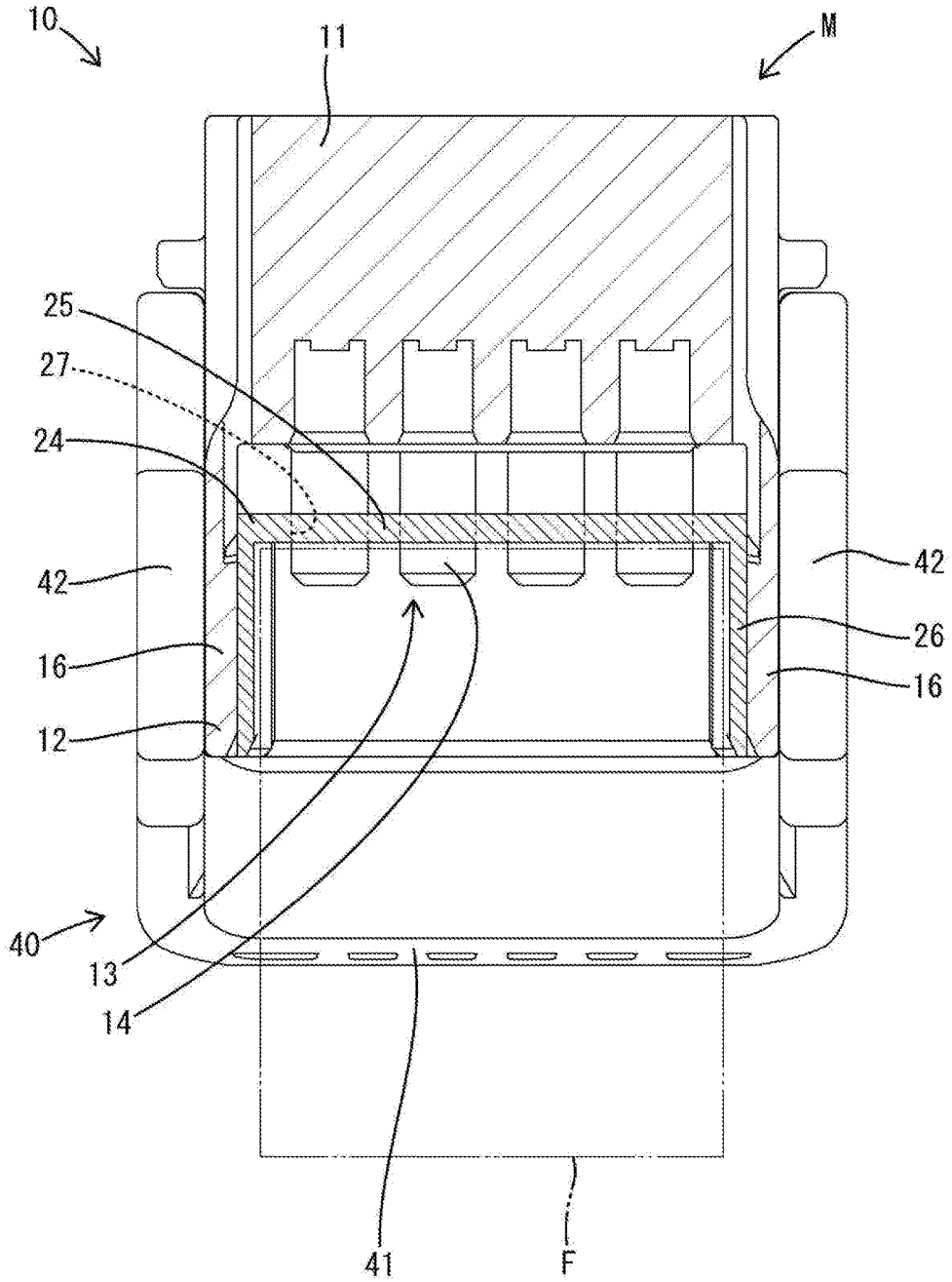
FIG. 7 is a section along X-X of FIG. 1.
Figure 8:
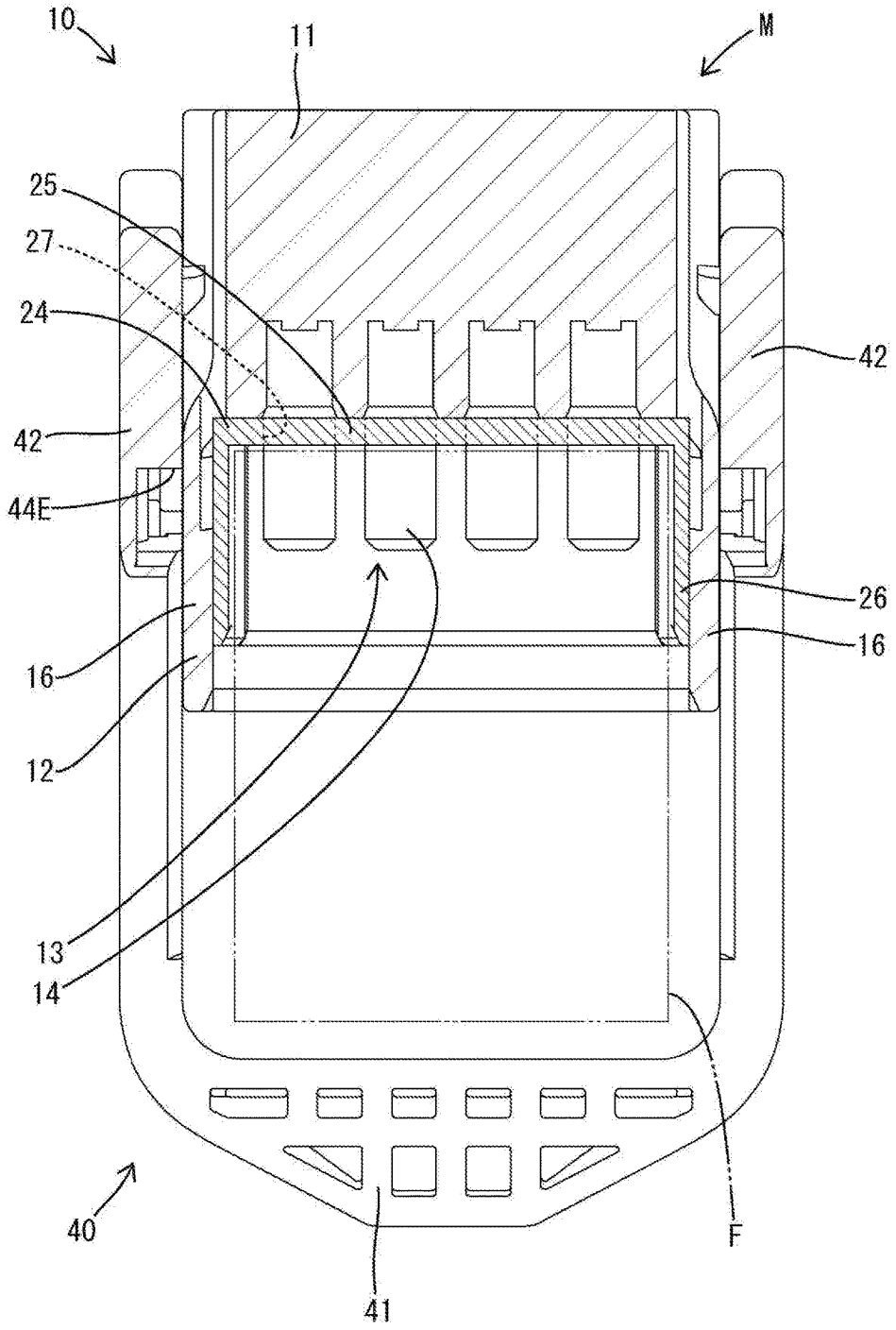
FIG. 8 is a section along X-X showing a state reached by rotating the lever toward the connection position from the state of FIG. 7.

An embodiment is described with reference to FIGS. 1 to 8. Note that, in the description of a lever-type connector M, a right side in FIG. 2 and a lower side in FIGS. 7 and 8 are defined as a front concerning a front-back direction for convenience sake. Left and right directions in FIG. 1 are defined as left and right directions concerning a lateral direction. Up and down directions in FIGS. 1 to 6 are defined as up and down directions concerning a vertical direction.

<Summary of Lever-Type Connector M>

Figure 2:
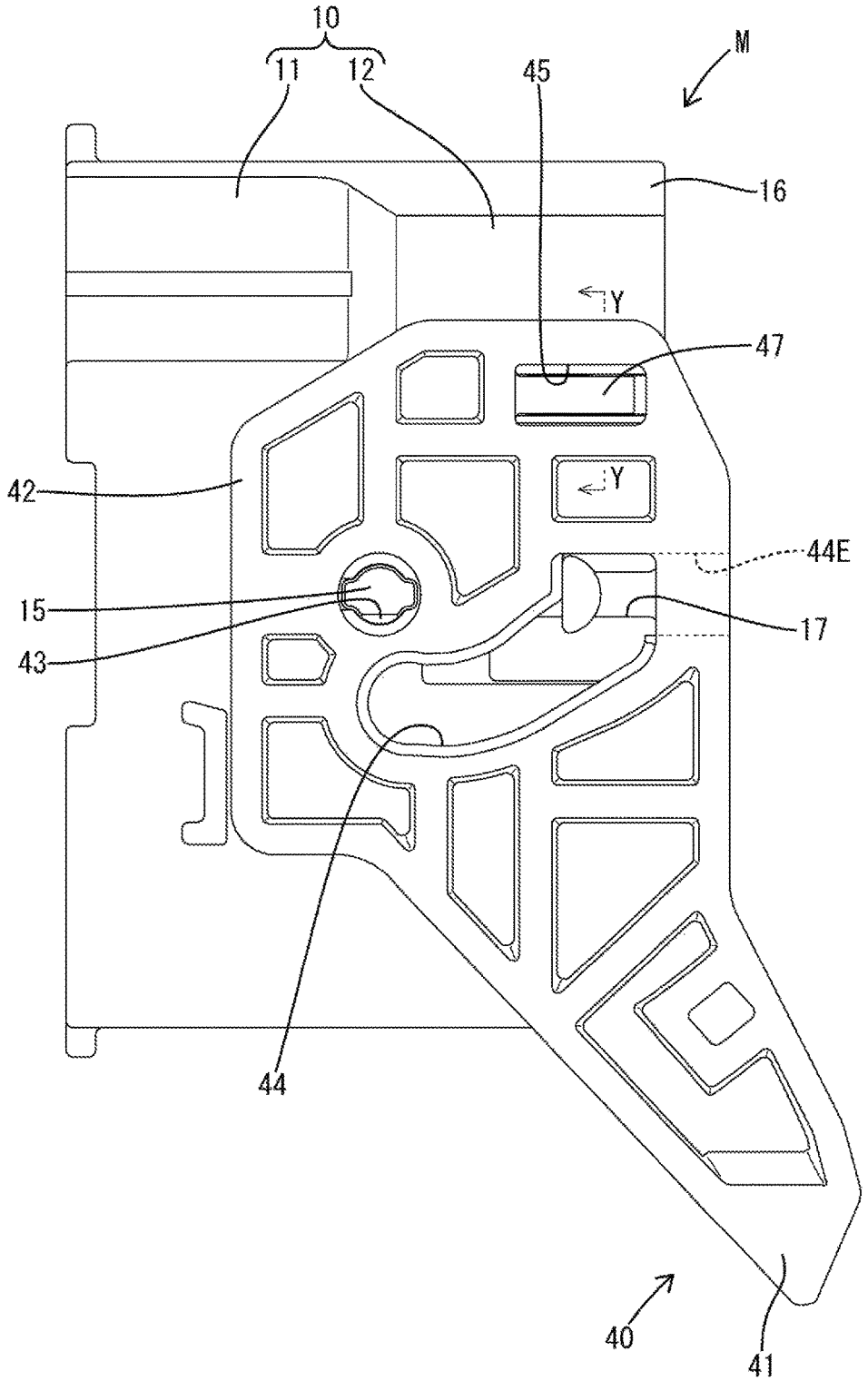
FIG. 2 is a side view of the lever-type connector.

The lever-type connector M includes a housing 10 made of synthetic resin, a moving plate 24 made of synthetic resin and a lever 40 made of synthetic resin. As shown in FIGS. 2, 7 and 8, the housing 10 is an integral assembly of a block-like terminal holding portion 11 and a rectangular tubular receptacle 12 extending forward from the outer peripheral edge of the front end of the terminal holding portion 11. As shown in FIGS. 7 and 8, male terminal fittings 13 are mounted in the terminal holding portion 11. A thin plate-shaped tab 14 is formed at a front end of the male terminal fitting 13 and projects forward from the terminal holding portion 11 into the receptacle 12.

<Housing 10>

As shown in FIG. 2, left and right rotary shafts 15 project respectively on left and right outer surfaces 10S of the housing 10. The rotary shafts 15 are arranged in a substantially central part in the vertical direction. As shown in FIGS. 1 and 2, left and right side walls 16 of the receptacle 12 are formed respectively with left and right first escaping grooves 17 that extend from the front end edges thereof toward the rotary shafts 15. The escaping grooves 17 extend straight and parallel to a connecting direction of the lever-type connector M and a mating connector F.

As shown in FIG. 1, the left and right side walls 16 are formed with long narrow first guiding grooves 18 at positions above the first escaping grooves 17 on the front end edges thereof in parallel to the first escaping grooves 17. The first escaping grooves 17 and the first guiding grooves 18 penetrate from the outer side surface 10S of the receptacle 12 to an inner side surface.

Locking holes 20 are formed at rear ends of the first guiding grooves 18 and function to hold the lever 40 at an initial position by lockingly engaging locking projections 49 of resilient locking pieces 47 formed on the lever 40. As shown in FIGS. 3 to 6, a locking edge 21 is formed on an upper side (front side in a displacing direction when the lever 40 rotates from the initial position toward a connection position) of the locking hole 20 facing the outer side surface 10S of the receptacle 12. An upper part of the inner surface of the locking hole 20 defines a flat undercut surface 22 aligned to the outer side surface 10S of the side wall 16 (receptacle 12) at an acute angle close to a right angle. The acute angle between the outer side surface 10S and the undercut surface 22 provides the locking edge 21 with a pointed wedge shape.

Figure 3:
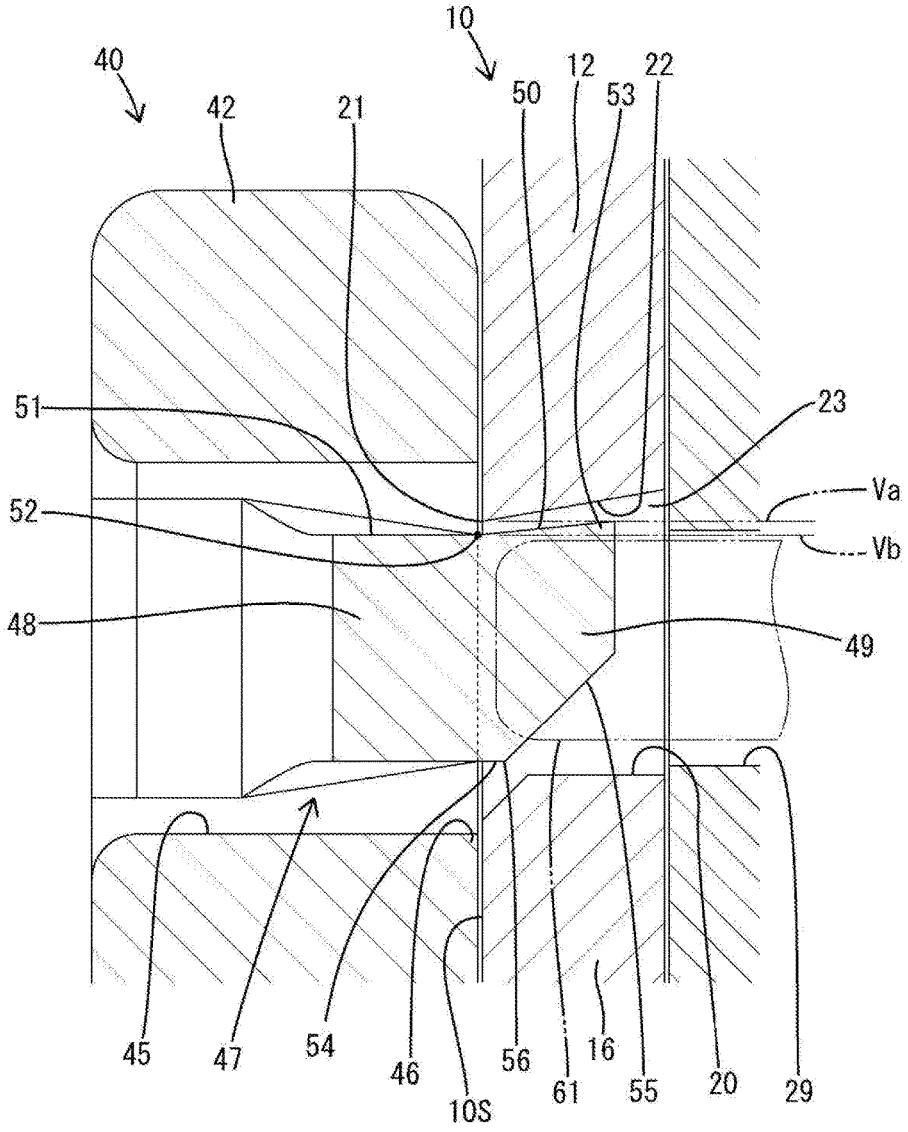
FIG. 3 is a section along Y-Y of FIG. 2.

The outer side surface 10S of the receptacle 12 is at a right angle to an axis of the rotary shaft 15, and the undercut surface 22 is inclined to retreat above the locking edge 21 with respect to the axis of the rotary shaft 15. As shown in FIG. 3, a recess 23 of triangular cross-section is formed between the undercut surface 22 of the locking hole 20 and a virtual boundary surface Va extending parallel to the rotary shaft 15 from the locking edge 21.

<Moving Plate 24>

As shown in FIGS. 1, 7 and 8, the moving plate 24 is accommodated in the receptacle 12 to be slidable in the front-back direction (direction parallel to the connecting direction of the lever-type connector M and the mating connector F) between a standby position (see FIG. 7) and a push-in position (see FIG. 8). The moving plate 24 is a unitary structure with a plate main body 25 at a right angle to a sliding direction and a peripheral wall 26 in the form of a rectangular tube extending forward from the outer peripheral edge of the plate main body 25. The plate main body 25 is formed with positioning holes 27 through tabs 14 are passed individually. The tabs 14 are positioned in the vertical and lateral directions by the positioning holes 27.

As shown in FIG. 1, left and right side panels of the peripheral wall 26 are formed respectively formed with second escaping grooves 28 and second guiding grooves 29. The second escaping grooves 28 are formed by cutting the side walls back parallel to the first escaping grooves 17 from the front end edges and are at the same position as the first escaping grooves 17 in the vertical direction. The second guiding grooves 29 are formed by cutting the side walls back parallel to the first guiding grooves 18 from the front end edges and are at the same position as the first guiding grooves 18 in the vertical direction.

As shown in FIG. 1, guide projections 30 are formed respectively on upper and lower end parts of the left and right side panels of the peripheral wall 26. On the other hand, upper and lower guide grooves 31 are formed on the inner surface of each of the left and right side walls 16 of the receptacle 12. The guide grooves 31 extend straight in the front-back direction. Four guide projections 30 slide in contact with these two pairs of guide grooves 31 so that the moving plate 24 is guided to move parallel in the receptacle 12 without inclining its posture.

<Lever 40>

As shown in FIGS. 1, 2, 7 and 8, the lever 40 is a unitary structure with an operating portion 41 that is long in the lateral direction. Left and right plate-like arms 42 extend parallel to one another from opposite left and right ends of the operating portion 41. A bearing hole 43 penetrates through each arm 42 in the plate thickness direction. The rotary shafts 15 fit into the bearing holes 43 so that the lever 40 is rotatable relative to the housing 10 between the initial position (see FIGS. 1, 2 and 7) and the connection position (see FIG. 8). Each arm 42 is formed with a cam groove 44 that opens on the outer peripheral edge thereof. Entrances 44E of the cam grooves 44 face forward and align with the first and second escaping grooves 17 and 28 when the lever 40 is at the initial position.

The left and right arms 42 are formed with substantially U-shaped slits 45. Each slit 45 penetrates from the outer surface to the inner surface (surface facing the housing 10) of the arm 42. The inner surface of the slit 45 is parallel to the axis of the rotary shaft 15 over the entire area thereof. Further, as shown in FIGS. 3 to 6, a lower part of an opening edge of the slit 45 on the inner surface of the arm 42 defines a pressing portion 46 facing a pressure receiving surface 54.

As shown in FIG. 2, areas of the left and right arms 42 surrounded by the slits 45 define left and right resilient locking pieces 47 that function to hold the lever 40 at the initial position. The resilient locking pieces 47 are arranged at the same height as the first guiding grooves 18, the second guiding grooves 29 and the locking holes 20 with the lever 40 at the initial position. The resilient locking piece 47 unitarily includes a resilient arm 48 extending in a cantilever manner and the locking projection 49 projecting toward the receptacle 12 housing 10 from an extending end of the resilient arm 48. An extending direction of the resilient arm 48 is a direction substantially perpendicular to the rotary shaft 15 of the lever 40 and intersects a circumferential direction about the rotary shaft 15. The resilient arm 48 is resiliently deformable with a base end part (end part connected to the arm 42) as a supporting.

The resilient arms 48 of the lever 40 that is held at the initial position are deformed resiliently in directions substantially parallel to the axes of the rotary shafts 15 (directions away from the housing 10 and left in FIGS. 3 to 6) to release the lever 40 from the initial position. Further, the resilient arms 48 deform resiliently to twist about lines along the extending directions thereof (not shown) when a rotational force is applied to move the lever 40 from the initial position toward the connection position.

The entire locking projections 49 are accommodated in the locking holes 20, as shown in FIG. 3, when the lever 40 is at the initial position. A locking surface 50 is defined at an area of the outer surface of the locking projection 49 facing up toward the undercut surface 22. The locking surface 50 is flat and extends over the entire area of the locking projection 49 in a projecting direction. When the resilient arm 48 is in a free state without being deformed resiliently, the locking surface 50 is oblique to the axis of the rotary shaft 15 and substantially parallel to the extending direction of the resilient arm 48, and the locking surface 50 is oblique to the undercut surface 22. Additionally, when the resilient arm 48 is in the free state, a vertical interval between the locking surface 50 and the undercut surface 22 increases gradually from the side of the locking edge part 21 toward an inner side of the receptacle 12.

A flat continuous surface 51 faces up on an area of the outer surface of the resilient arm 48 directly connected to the locking surface 50. The entire continuous surface 51 is outside the locking hole 20 when the resilient arm 48 is in the free state. Further, the continuous surface 51 is parallel to the axis of the rotary shaft 15 and substantially parallel to the extending direction of the resilient arm 48 when the resilient arm piece 48 is in the free state. A boundary 52 of the locking surface 50 to the continuous surface 51 is recessed at an obtuse angle slightly smaller than 180°.

The boundary 52 is at the same position as the locking edge 21 in the projecting direction of the locking projection 49 from the resilient arm 48. Further, a hook 53 is defined by an area of the locking projection 49 of triangular cross-section and closer to the locking surface 50 than a virtual reference surface Vb, which is an extension of the continuous surface 51.

A downward facing area (surface opposite to the locking surface 50) of the outer surface of the locking projection 49 is composed of the pressure receiving surface 54 and an escaping surface 55. The pressure receiving surface 54 is flat and parallel to the continuous surface 51. A formation area of the pressure receiving surface 54 in the projecting direction of the locking projection 49 is a narrow range along a base end part (i.e. an end part connected to the resilient arm 48) of the locking projection 49.

The escaping surface 55 is connected at an obtuse angle (angle larger than 90° and smaller than 180°) to the pressure receiving surface 54. The escaping surface 55 is substantially parallel to the extending direction of the resilient arm 48 and inclined at a large angle to the axis of the rotary shaft 15 when the resilient arm 48 is in the free state. A formation area of the escaping surface 55 in the projecting direction of the locking projection 49 is a wide range from the projecting end of the locking projection 49 to the pressure receiving surface 54. An interval between the locking surface 50 and the escaping surface 55, i.e. a vertical thickness of the locking projection 49 is reduced gradually in the projecting direction of the locking projection 49. Further, an area of an outer surface part of the locking projection 49 where the pressure receiving surface 54 and the escaping surface 55 are connected at an obtuse angle serves as an auxiliary hook 56.

<Mating Connector F>

The mating connector F to be connected to the lever-type connector M is block-shaped as a whole. As shown in FIG. 1, left and right side surfaces of the mating connector F are formed with cylindrical cam followers 60 and long narrow lock releasing ribs 61 extending in the front-back direction.

<Functions and Effects>

The lever 50 is held at the initial position before the lever-type connector M is connected to the mating connector F. The locking projections 49 then are inserted in the locking holes 20 and the boundary parts 52 of the locking surfaces 50 to the continuous surfaces 51 and the locking edge parts 21 of the locking holes 20 proximately face each other, as shown in FIG. 3.

Figure 4:
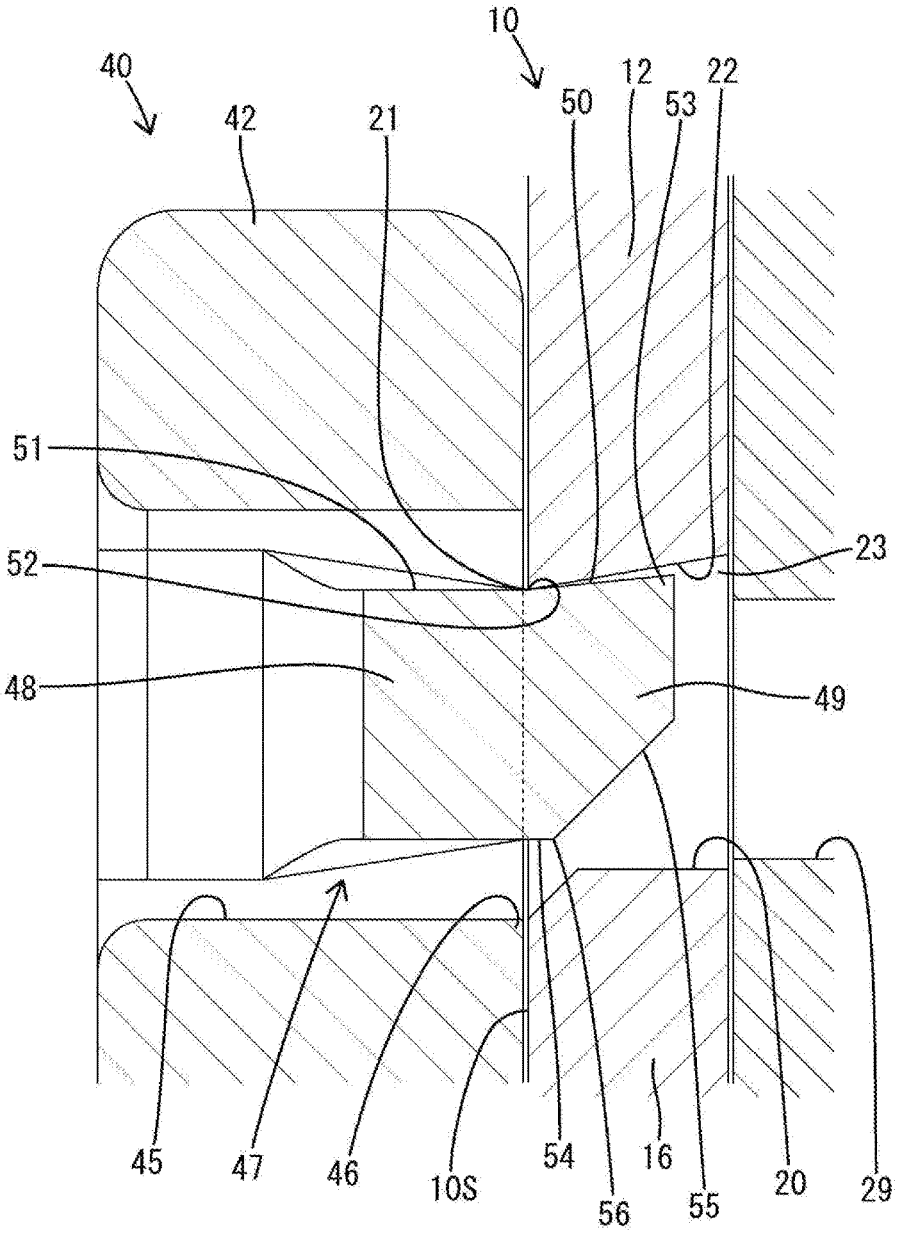
FIG. 4 is a section along Y-Y showing a state reached by rotating a lever toward a connection position from a state of FIG. 3.

The rotation of the lever 40 toward the connection position is started from this state. As a result, the boundaries 52 of the locking surfaces 50 contact the locking edges 21, as shown in FIG. 4. Then, the wedge-shaped locking edges 21 are locked to the boundaries 52 recessed at an obtuse angle to bite into the boundaries 52, and the hooks 53 of the locking projections 49 enter the recesses 23 of the locking holes 20. The contact of the hooks 53 with the locking edges 21 regulate detachment of the locking projections 49 from the locking holes 20 toward the lever 40, thereby maintaining a locked state of the locking surfaces 50 (locking projections 49) and the locking edges 21 (locking holes 20).

Figure 5:
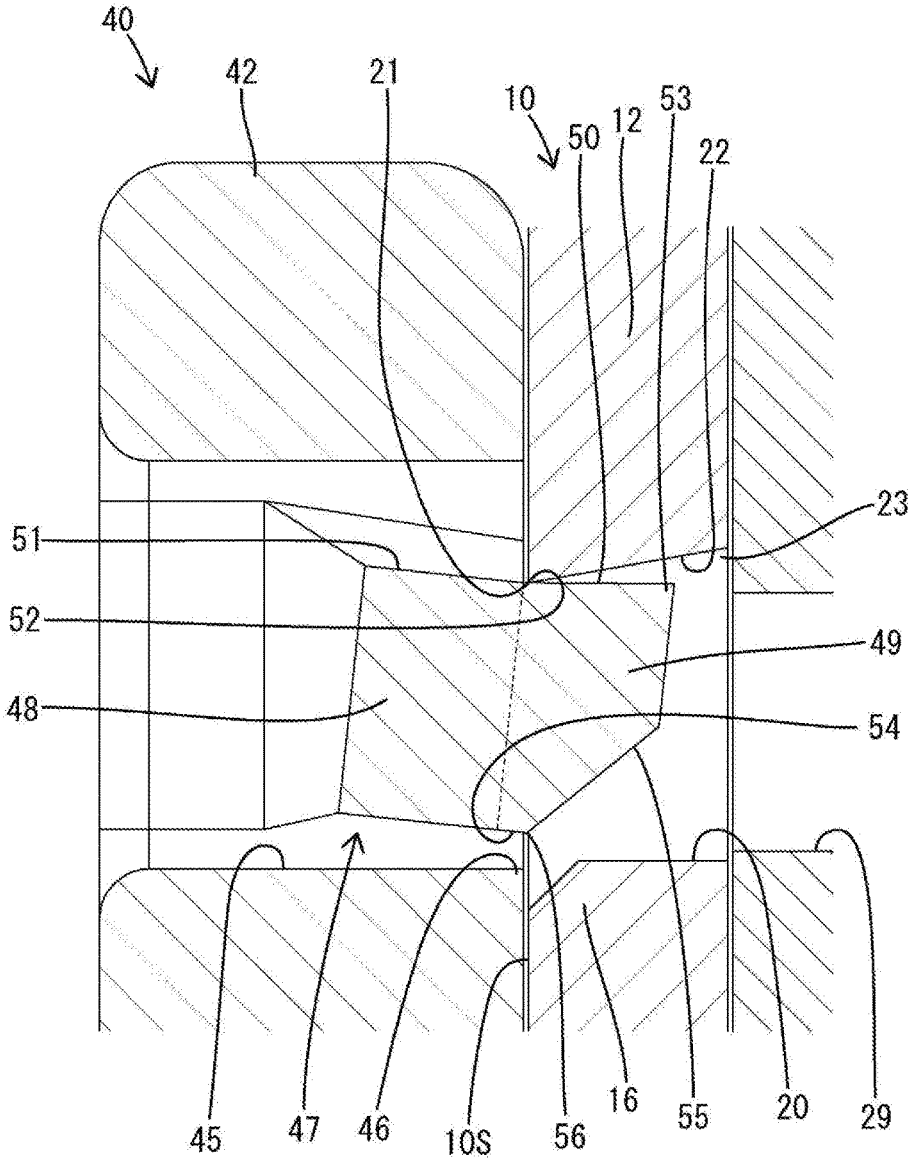
FIG. 5 is a section along Y-Y showing a state reached by rotating the lever toward the connection position from the state of FIG. 4.

When the lever 40 further rotates toward the connection position from the state shown in FIG. 4, the locking projections 49 are inclined clockwise with the contact positions of the locking edges 21 and the boundaries 52 as supports and the resilient arms 48 are twisted resiliently in the same direction, as shown in FIG. 5. At this time, the locking projections 49 may detach from the locking holes 20 due to resilient restoring forces of the resilient arms 48, but the locking edges 21 bite more strongly into the boundaries 52 due to the resilient restoring forces of the resilient arms 48 so that the locking projections 49 cannot detach from the locking holes 20.

Figure 6:
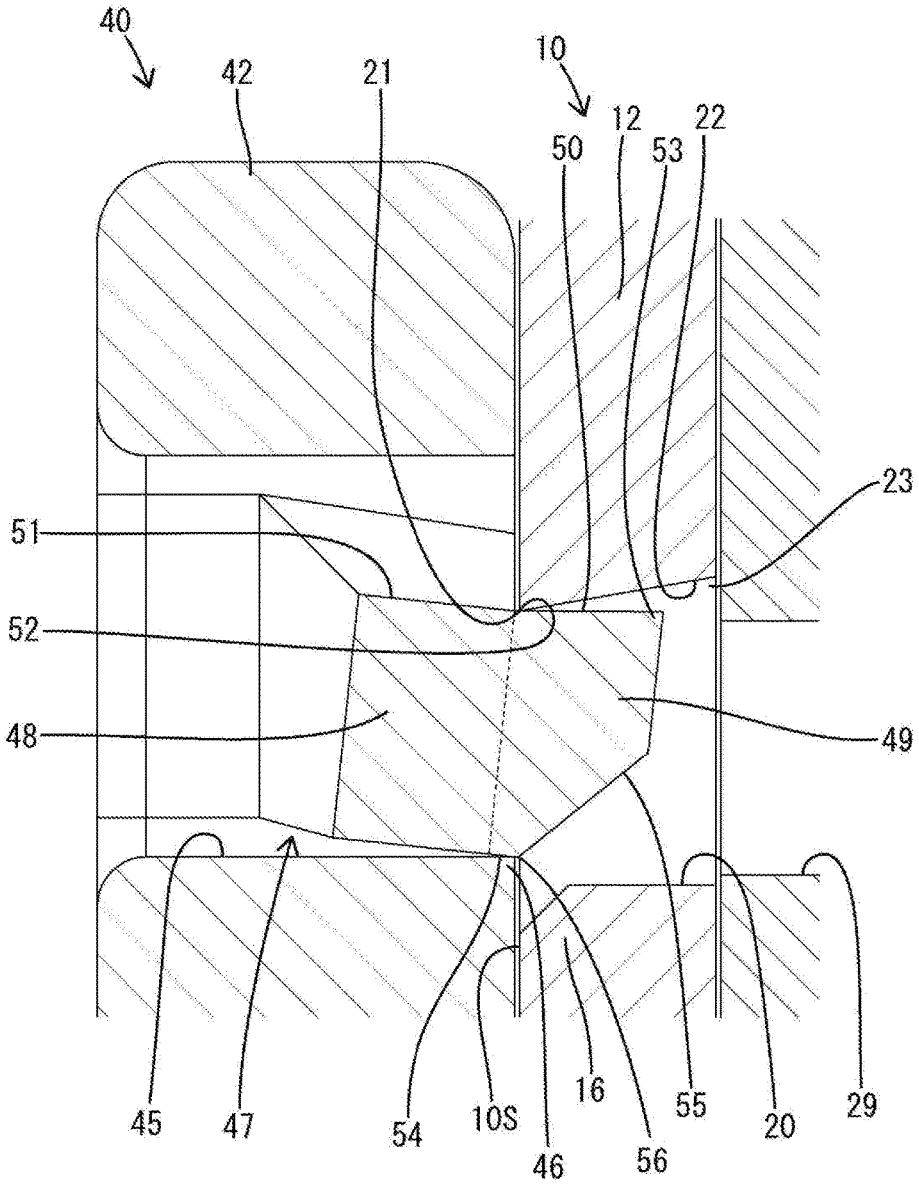
FIG. 6 is a section along Y-Y showing a state reached by rotating the lever toward the connection position from the state of FIG. 5.

When the lever 40 rotates further toward the connection position from the state shown in FIG. 5, the locking projections 49 incline further, the resilient arm pieces 48 twist further, the pressure receiving surfaces 54 contact the pressing portions 46, as shown in FIG. 6, and the auxiliary hooks 56 obliquely contact the pressing portions 46 from the sides of the locking holes 20. Thus, base ends of the locking projections 49 are sandwiched between the locking edges 21 and the pressing portions 46 in the vertical direction (displacing direction when the rotation of the lever 40 from the initial position toward the connection position is started). In this way, the postures of the locking projections 49 are fixed and the locking edges 21 firmly bite into the boundaries 52.

In this state, forces are given to the locking projections 49 in a counterclockwise direction of FIG. 6 to return the locking projections 49 toward the initial postures due to the resilient restoring forces of the resilient arms 48. However, if the locking projections 49 return to the initial postures in the counterclockwise direction, the hooks 53 of the locking projections 49 enter the recesses 23 of the locking holes 20 and are locked to the locking edge 21 from the inner sides of the locking holes 20. Therefore the locking projections 49 are not detached from the locking holes 20.

Further, since the auxiliary hooks 56 come into contact with and are hooked to the pressing portions 46 from the sides of the locking holes 20, it is also regulated that the locking projections 49 come out of the locking holes 20 while being kept in the fixed postures. Thus, the locked state of the boundaries 52 of the locking projections 49 and the locking edges 21 of the locking holes 20 is maintained reliably. In this way, the lever 40 is held reliably at the initial position.

In connecting the lever-type connector M and the mating connector F, the mating connector F is fit lightly into the receptacle 12 (moving plate 24) and the cam followers 60 are inserted into the entrances 44E of the cam grooves 44 through the first and second escaping grooves 17, 28 with the lever 40 located at the initial position. When the mating connector F is fit into the receptacle 12, the lock releasing ribs 61 of the mating connector F enter the first and second guiding grooves 18, 29 and interfere with the locking projections 49 in the locking holes 20. The locking projections 49 then are pushed out of the locking holes 20 by the lock releasing ribs 61 to release the locking of the locking projections 49 and the locking holes 20. In this way, the lever 40 is permitted to rotate from the initial position toward the connection position. Subsequently, the two connectors F, M are pulled toward each other by a cam action due to the engagement of the cam grooves 44 and the cam followers 60 as the lever 40 is rotated toward the connection position. The two connectors F, M are connected properly when the lever 40 reaches the connection position.

As described above, the lever-type connector M has the housing 10 with the male terminal fittings 13 mounted therein and the lever 40 is mounted rotatably on the housing 10. The lever 40 is rotated from the initial position to the connection position to connect the housing 10 and the mating connector F. The housing 10 is formed with the locking holes 20, and the lever 40 is formed with the resilient arms 48 cantilevered in the direction substantially perpendicular to the rotary shafts 15 of the lever 40 and intersecting with the circumferential direction about the rotary shafts 15. The locking projections 49 project from the extending ends of the resilient arms 48 and hold the lever 40 at the initial position by entering the locking holes 20 and being locked.

The locking hole 20 has the locking edge 21 located on the outer surface of the receptacle 12 and is configured to lock the locking projection 49, and the recess 23 is formed by recessing the inner surface on the deeper side than the locking edge 21. On the other hand, the locking projection 49 is formed with the hook 53 configured to enter the recess 23 with the locking projection 49 locked to the locking edge 21. In a state where the locking projection 49 is locked to the locking edge 21 and the hook 53 is inserted in the recess 23, the hook 53 is hooked to the locking edge 21 so that the locking projection 49 cannot detach from the locking hole 20. The locked state of the locking projections 49 and the locking edge 21 is stabilized in this way so that the lever 40 is held reliably at the initial position.

Further, the hook 53 is formed with the locking surface 50 facing the recess 23, the resilient arm 48 is formed with the continuous surface 51 connected to the locking surface 50 and the boundary 52 of the locking surface 50 to the continuous surface 51 is recessed at an obtuse angle. The locking edge 21 is wedge-shaped and is locked to the boundary 52 to bite into the boundary 52. According to this configuration, the locked state of the locking projection 49 and the locking edge part 21 is more stabilized since the locking edge 21 is locked to the boundary 52 of the locking surface 50 to the continuous surface 51 to be fit into the boundary part 52.

Further, when the lever 40 is rotated toward the connection position with the locking surface 50 locked to the locking edge 21, the resilient arms 48 are displaced in directions to detach the locking projections 49 from the locking holes 20 while being twisted. The lever 40 is formed with the pressing portions 46 located to sandwich the locking projections 49 between the locking edge 21 and the pressing portions 46 and the locking projections 49 are formed with the auxiliary hooks 56. The auxiliary hooks 56 are hooked to the pressing portions 46 from the sides of the locking holes 20 with the locking projections 49 sandwiched between the locking edge 21 and the pressing portions 46. Accordingly, when the locking projections 49 are sandwiched between the locking edges 21 and the pressing portions 46 with the resilient arms 48 twisted, the auxiliary hooks 56 are locked to the pressing portions 46 from the sides of the locking holes 20. Therefore, the locking projections 49 cannot detach from the locking holes 20.

The arm 42 of the lever 40 is a flat plate with the substantially U-shaped slit 45 penetrating in the plate thickness direction of the arm 42. The area surrounded by the slit 45 defines the resilient arm 48. The inner surface of the slit 45 and the outer surface of the resilient arm 48 are parallel to the rotary shaft 15. Accordingly, a removal direction of a mold (not shown) for molding the slits 45 and the resilient arms 48 is parallel to the rotary shafts 15. Therefore, a mold can be simplified.

The invention is not limited to the above described and illustrated embodiment. For example, the following embodiments also are included in the scope of the invention.

Although the boundary part of the locking surface to the continuous surface is recessed at an obtuse angle in the above embodiment, it may be recessed arcuately.

The locking edge is wedge-shaped and bites into the locking surface in the above embodiment. However, the locking edge may be in surface contact with and locked to the locking surface.

The locking surface and the continuous surface are connected at an obtuse angle in the above embodiment, but may be continuous and flush with each other.

The auxiliary hooking is formed on the locking projection in the above embodiment, but the locking projection may be formed without the auxiliary hook.

The inner surface of the slit and the outer surface of the resilient arm are parallel to the rotary shaft in the above embodiment. However, the inner surface of the slit and the outer surface of the resilient arm may be at least partly oblique to the rotary shaft.

LIST OF REFERENCE SIGNS

F . . . mating connector
M . . . lever-type connector
10 . . . housing
10S . . . outer side surface (surface of housing facing lever)
13 . . . male terminal fitting (terminal fitting)
15 . . . rotary shaft
20 . . . locking hole
21 . . . locking edge
23 . . . recess
40 . . . lever
42 . . . arm
45 . . . slit
46 . . . pressing portion
48 . . . resilient arm
49 . . . locking projection
50 . . . locking surface
51 . . . continuous surface
52 . . . boundary
53 . . . hook
56 . . . auxiliary hook

What is claimed is:

1. A lever-type connector, comprising:

a housing having a terminal fitting mounted therein, the housing having a wall with an outer surface, a rotary shaft projecting from the outer surface, a locking hole formed in the wall, the locking hole including a locking edge at the outer surface and an undercut surface extending from the locking edge and aligned at an acute angle to form a recess in the locking hole;

a lever rotatably mounted on the on the rotary shaft of the housing and configured to connect the housing and a mating connector by being rotated in a connecting direction from an initial position to a connection position;

a resilient arm formed at the lever and cantilevered in a direction substantially perpendicular to the rotary shaft of the housing and intersecting with a circumferential direction about the rotary shaft; and a locking projection projecting from an extending end part of the resilient arm and configured to hold the lever at the initial position by entering the locking hole and being locked, a hook projecting from a side of the locking projecting that faces the recess and projecting farther toward the recess at positions on the locking projection farther from the resilient arm, wherein:

rotating forces to urge the lever in the connecting direction before a connecting operation with the mating connector cause the hook to enter the recess for preventing a deflection of the resilient arm that could separate the locking projection from the locking hole.

2. The lever-type connector of claim 1, wherein:

the hook is formed with a locking surface facing the recess;

the resilient arm is formed with a continuous surface connected to the locking surface;

a boundary part of the locking surface to the continuous surface is recessed at an obtuse angle; and the locking edge is wedge-shaped and locked to the boundary part.

3. The lever-type connector of claim 2, wherein:

the resilient arm is displaced in a direction to detach the locking projection from the locking hole while being twisted when the lever is rotated in a direction toward the connection position with the locking surface locked to the locking edge;

the lever is formed with a pressing portion located to sandwich the locking projection between the locking edge and the pressing portion; and the locking projection is formed with an auxiliary hooking portion configured to be hooked to the pressing portion from the side of the locking hole with the locking projection sandwiched between the locking edge part and the pressing portion.

4. The lever-type connector of claim 1, wherein:

the lever has a lever arm substantially in the form of a flat plate, the lever arm being formed with a substantially U-shaped slit penetrating in a plate thickness direction of the lever arm;

an area surrounded by the slit defining the resilient arm; and an inner surface of the slit and an outer surface of the resilient arm are parallel to the rotary shaft.

5. The lever-type connector of claim 1, wherein the hook projects from a side of the locking projection facing in the connection direction of rotation of the lever from the initial position to the connection position.

6. The lever-type connector of claim 5, wherein a side of the locking projection opposite the hook includes a pressure receiving surface adjacent the resilient arm and extending in a projecting direction of the locking projection from the resilient arm, and an escaping surface sloped from the pressure receiving surface to approach the hook at positions closer to a projecting end of the locking projection.

7. The lever-type connector of claim 6, wherein the pressure receiving surface and the escaping surface intersect at an obtuse angle that defines an auxiliary hook, the hook and the auxiliary hook being squeezed between the locking edge of the housing and an edge of the lever facing the resilient arm when the lever is urged in the connecting direction before a connecting operation with the mating connector.

8. The lever-type connector of claim 1, wherein the lever is formed with a cam groove spaced from the resilient arm.

9. The lever-type connector of claim 1, wherein the housing has a front end configured for connecting to the mating connector and a rear end opposite the front end, the cam groove being open toward the front end when the lever is at the initial position.

10. The lever-type connector of claim 9, wherein the resilient arm is cantilevered toward the front end of the housing.

11. The lever-type connector of claim 10, wherein the housing is formed with a guiding groove extending from the locking hole to the front end of the housing, the guiding groove being configured to receive a lock releasing rib of the mating connector for engaging the locking projection during connection of the housing and the mating connector and deflecting the resilient arm sufficiently to disengage the locking projection from the locking hole.

12. The lever-type connector of claim 11, wherein the hook is deflectable passed the locking edge when the lever is at the initial position.

* * * * *